US009199753B2

(12) United States Patent
Tacchini et al.

(10) Patent No.: US 9,199,753 B2
(45) Date of Patent: Dec. 1, 2015

(54) COMPACT STRAPPING HEAD

(71) Applicant: OFFICINA MECCANICA SESTESE S.p.A., Paruzzaro (Novara) (IT)

(72) Inventors: Franco Tacchini, Nebbiuno (IT); Maurizio Orfano, Arona (IT)

(73) Assignee: OFFICINA MECCANICA SESTESE S.P.A., Paruzzaro (Novara) (IT)

( * ) Notice: Subject to any disclaimer, the term of this patent is extended or adjusted under 35 U.S.C. 154(b) by 0 days.

(21) Appl. No.: 14/492,542

(22) Filed: Sep. 22, 2014

(65) Prior Publication Data

US 2015/0083000 A1 Mar. 26, 2015

(30) Foreign Application Priority Data

Sep. 20, 2013 (IT) ..... MI2013A1553

(51) Int. Cl.

*B65B 13/22* (2006.01)
*B65B 13/32* (2006.01)
*B65B 13/04* (2006.01)
*B65B 65/02* (2006.01)

(52) U.S. Cl.

CPC ..... *B65B 13/04* (2013.01); *B65B 13/22* (2013.01); *B65B 13/32* (2013.01); *B65B 65/02* (2013.01)

(58) Field of Classification Search

CPC ..... B65B 13/04; B65B 13/22; B65B 13/24; B65B 13/32; B65B 65/02
USPC ..... 100/26, 29, 32; 53/589
See application file for complete search history.

(56) References Cited

U.S. PATENT DOCUMENTS

| | | | | |
|---|---|---|---|---|
| 3,759,169 | A | 9/1973 | Goodley | |
| 3,949,662 | A | 4/1976 | Woomer | |
| 4,254,703 | A * | 3/1981 | Fulton et al. | 100/2 |
| 2004/0244607 | A1 * | 12/2004 | Corbin et al. | 100/29 |
| 2009/0044645 | A1 * | 2/2009 | Buescher | 74/89 |

FOREIGN PATENT DOCUMENTS

| | | | |
|---|---|---|---|
| DE | 28 18 325 | A1 | 11/1979 |
| EP | 1 275 586 | A1 | 1/2003 |
| WO | 2004/067383 | A1 | 8/2004 |

OTHER PUBLICATIONS

IT Search Report, dated May 28, 2014, from corresponding IT application.

* cited by examiner

*Primary Examiner* — Jimmy T Nguyen
(74) *Attorney, Agent, or Firm* — Young & Thompson

(57) ABSTRACT

A strapping head for a strapping machine includes a containment frame for housing at least a strap launch/rewind path defined by a launch/tensioning assembly including a plurality of driving wheels of the strap, a welding assembly and a gripping and cutting device the driving wheels of the launch/tensioning assembly being brought into rotation by a first actuation motor, wherein all of the launch/tensioning assembly, welding assembly and gripping and cutting device have driving members driven into movement through a single linear cam apt to move alternately in the longitudinal direction through a second actuation motor and having cam profiles both on an horizontal plane and on a vertical plane, and the linear cam is actuated by the second driving motor being integral in rotation with screwed spindle transmission elements mutually cooperating with screw nut elements integral with the linear cam.

20 Claims, 11 Drawing Sheets

COMPACT STRAPPING HEAD

FIELD OF THE INVENTION

The present invention refers to a strapping head for strapping machines, in particular to a small-sized strapping head.

BACKGROUND ART

As known, a much-used wrapping technique provides to wrap tightly a load to be transported with one or more strap loops. The strap is a thin tape, normally of plastic material (but in some cases also of metal), which is tightly wound loop-like around a load, closing it permanently by means of welding points between the two terminal lips.

The welding avoids a reopening of the strap loop, which must hence then be severed to free the wrapping.

Welding types can vary, also depending on the type of material of the strap. However, all strapping machines substantially resort to a strapping head which has two complementary and integrated functions: on the one hand, the launch and subsequent rewind of the strap with tightening around the product to be wrapped and, on the other hand, the welding of the two terminal lips.

Normally a single strapping head, mounted below the load-transit plane, embeds a series of motion devices and mechanism which perform all the above-said functions, that is, they feed and launch the strap around the load, starting from a storage spool, they block the free end and retrieve the base portion, until choking a strap loop around the load; finally, they perform the welding in the loop closing area and severe it from the rest of the strap coming from the spool.

This assembly is rather complex and bulky. As a matter of fact, it comprises various transmission members, actuation cams, rotation mechanisms and motors, all the above mounted on a sturdy containment frame. That causes the entire head to weigh several tens of kilograms and is hence cumbersome to move. Vice versa, for various maintenance operations, it would be desirable to be able to easily disassemble and displace the head, so as to replace it easily or to perform the necessary inspections with ease.

For such purpose, it has already been suggested to divide the strapping head into at least two main assemblies, one delegated to the strap launching and retrieving function, with the relative motorisation, the other delegated to strap welding and cutting, with relative motorisation. The disassembling into two assemblies has the advantage of dramatically improving the opportunity for inspection and for replacement. Some examples consistent with this approach are represented by EP1275586 and by the Italian application MI2010A2231 in the name of the same Applicant.

Although some of these systems are advantageous, it has been realised that the user of these apparatuses would in any case wish to be able to have—at least in the least burdensome applications—a single strapping head, preferably compact and light so as to be able to be held comfortably.

The Applicant has hence further focused on the problem of making an integral strapping head light and compact. When faced with such problem, it has become apparent that a construction constraint of known heads is that of having to displace with rotating shafts (those of electric motors) both elements with a longitudinal main movement (the strap launching and rewinding axis) and elements with a crosswise main movement (the components of the welding system). That implies providing cam transmissions on orthogonal planes, which have a significant space occupation, determine project constraints and, due to the cyclicity thereof on the single motor shaft revolution, require complex transmission rotation mechanisms to define the motion laws suited to the various displacement members. All that ends up having a negative influence both on manufacturing costs and on apparatus weight.

The prior art offers rare examples of strapping heads wherein use is made of controls of an alternative shape. One of these is represented by U.S. Pat. No. 3,759,169, wherein part of an actuation is entrusted to a linear cam, instead of to a classic rotating cam; in particular, the control of the strap retaining grippers is entrusted to a pneumatic actuation through a single linear cam where displacement of the follower is made only on a vertical plane (i.e. orthogonal with respect to the plane of displacement of the grippers). However, these known solutions have not proved effective because they comprise mixed actuations and hence overall they have significant bulks, as well as having a pneumatic control, hence they are capable of expressing a low force, are little controllable and little accurate in position.

SUMMARY OF THE INVENTION

The object of the present invention is hence that of providing a strapping head which overcomes the drawbacks of the prior art. In particular a strapping head which, through a different configuration of the transmission members, allows to compact and lighten the structure thereof, until a weight and bulk limit suited to an easy hand handling, despite guaranteeing high precision and control sturdiness.

Such object is achieved through a strapping head and a relative strapping machine as described in its essential features in the attached main claim.

Other inventive aspects of the device are described in the dependent claims.

In particular, according to a first aspect of the invention, it is provided a strapping head for a strapping machine, comprising a containment frame suitable to house at least a strap launch/rewind path defined by a launch/tensioning assembly comprising a plurality of driving wheels of said strap, a welding assembly and a gripping and cutting device comprising locking grippers, a moving abutment plate and a cutter, said driving wheels of the launch/tensioning assembly being brought into rotation by a first actuation motor, wherein all of said launch/tensioning assembly, welding assembly and gripping and cutting device have driving members driven into movement through a single linear cam apt to move alternately in the longitudinal direction through a second actuation motor and having cam profiles both on an horizontal plane and on a vertical plane, and said linear cam is actuated by said second driving motor being integral in rotation with screwed spindle transmission means mutually cooperating with screw nut means integral with said linear cam.

According to a preferred aspect, said screwed spindle and nut transmission means are in the shape of a helical-groove screwed spindle engaged with said screw nut transmission means in the shape of a recirculating ball body integral in translation with said linear cam.

Preferably said second actuation motor is connected to said screwed spindle transmission means through a pulley transmission.

According to another aspect, the containment frame is box-shaped and is divided by a longitudinal diaphragm, whereon sliding guiding means are fastened for said linear cam. This latter is preferably arranged on a first side of said longitudinal diaphragm, while said launch/rewind path of the strap is arranged on the opposite side.

According to a preferred aspect, said longitudinal diaphragm has at least an upper cut-out which houses a crosswise displacement path of said moving abutment plate. Said driving wheels are driven by motor shafts arranged crosswise to said longitudinal diaphragm.

According to a further aspect said linear cam is in the shape of a planar plate provided with first cam profiles obtained on shaped edges, for defining cam controls on the sliding vertical plane, and second cam profiles, orthogonal to said first profiles, obtained on small bodies protruding from the plate plane, for defining cam controls orthogonal to the sliding vertical plane.

Said moving abutment plate of the gripping and cutting device is driven crosswise by said second cam profiles.

BRIEF DESCRIPTION OF THE DRAWINGS

Further features and advantages of the strapping head according to the invention will in any case be more evident from the following detailed description of a preferred embodiment of the same, given by way of example and illustrated in the attached drawings, wherein.

DETAILED DESCRIPTION OF A PREFERRED EMBODIMENT

A strapping machine (not shown) comprises, in a way known per se, a frame whereon a strap launch track is provided, arranged around a support and transit plane of a load to be wrapped. Below the support and transit plane, in correspondence of the entry onto the launch track, a strapping head is arranged, conceptually known per se.

It must be considered that, in the following of the description, expressions such as above/below, or vertical/horizontal, are used with reference to the drawings and to the attitude of the apparatus in its installed and in-use position. Similarly, terms such as "longitudinal" and "transversal" are to be understood as referring to the strap launch and rewind path.

The strapping head typically comprises in sequence, in the strap launching direction, a strap launch and rewind assembly, provided with suitable actuation wheels, and then a welding assembly, apt to block the free end of the strap (once launched and wound around the load to be wrapped) against a remaining base portion of the strap and to weld together these portions, so as to define a closed strap loop tightened around the load to be wrapped. A cutting unit is furthermore provided for severing the strap loop from the remaining supply portion, at the end of the strapping cycle.

The strapping head typically represents a self-standing apparatus, which may be disassembled from the remaining frame of the machine for ordinary maintenance and/or replacement operations.

Figure 1A:
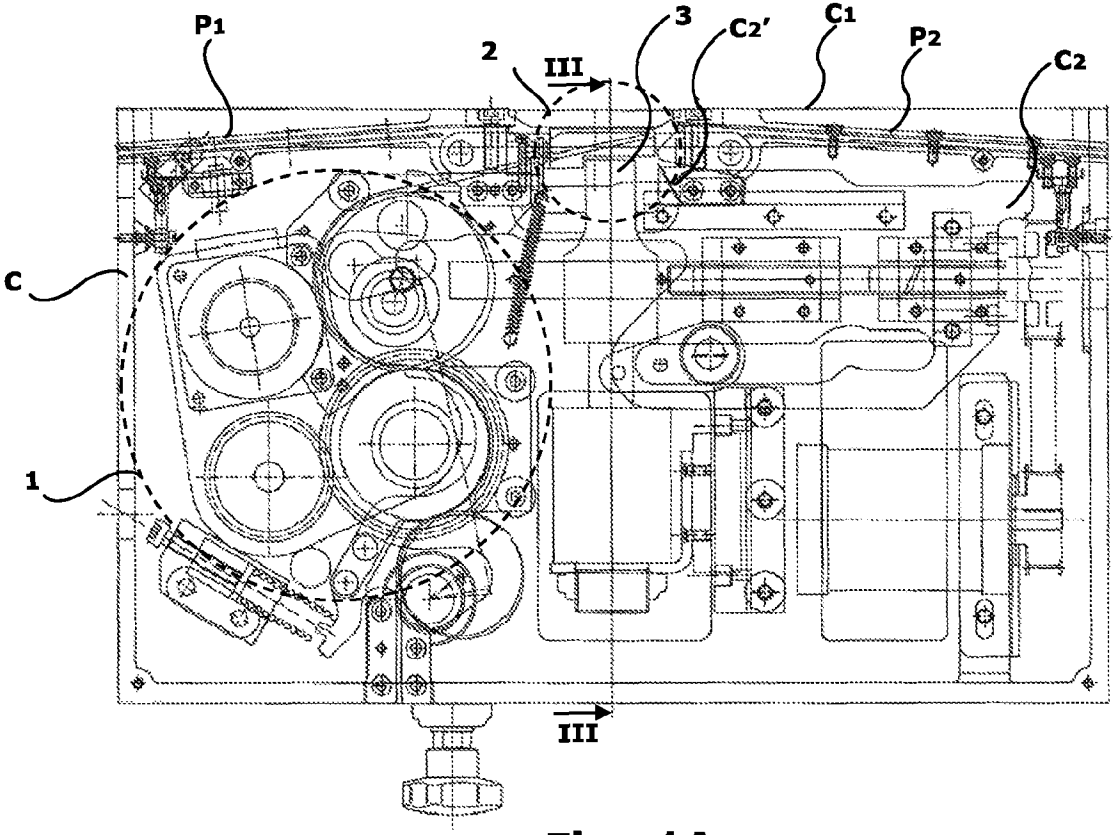
FIG. 1A is an elevation side view of a launch side of the strapping head (devoid of a closing cover) according to the invention.
Figure 1B:
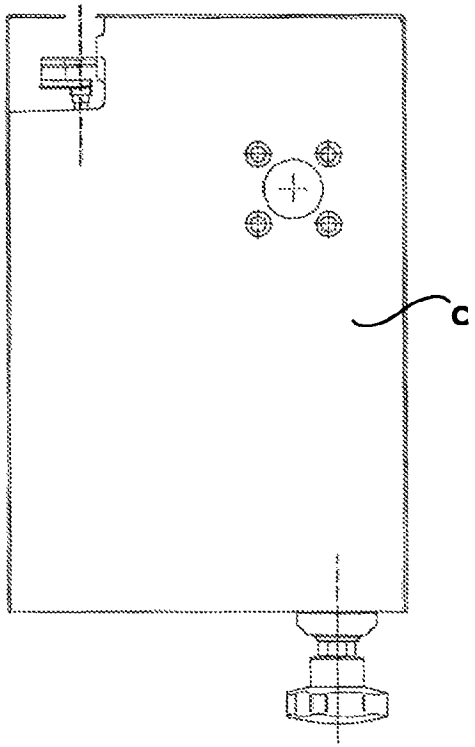
FIG. 1B is a front elevation view of the right end of FIG. 1A.

As schematically shown in FIG. 1A, a strapping head comprises a box frame C, which ends above with support ribbings C1 of a closing plane belonging to the work plane of the machine. Within box frame C a strap launch and rewind assembly 1, a strap gripping and cutting device 2 and a welding device 3 are typically housed.

Figure 2A:
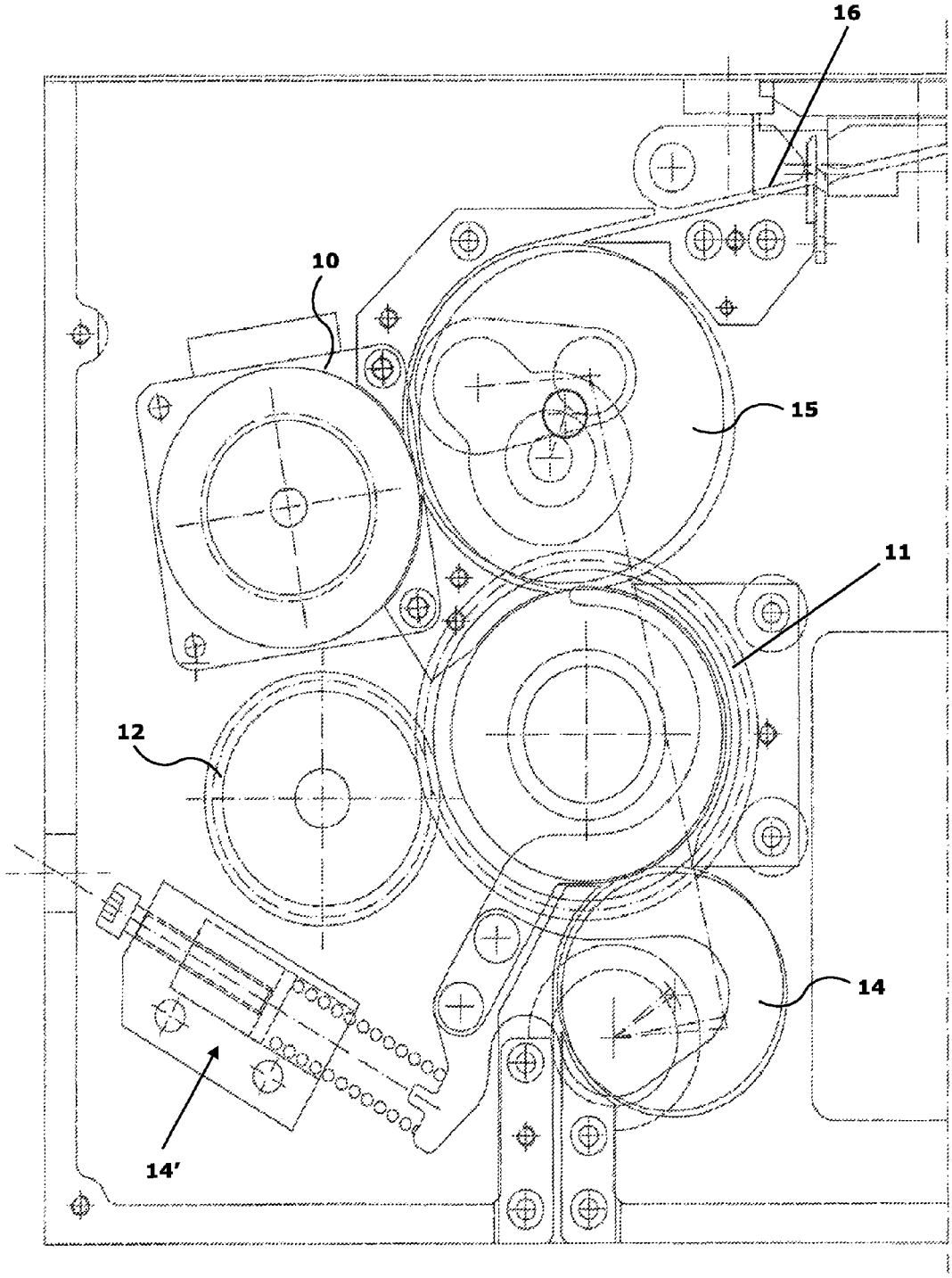
FIG. 2A is a detailed side elevation view of the strap launch and rewind assembly.
Figure 2B:
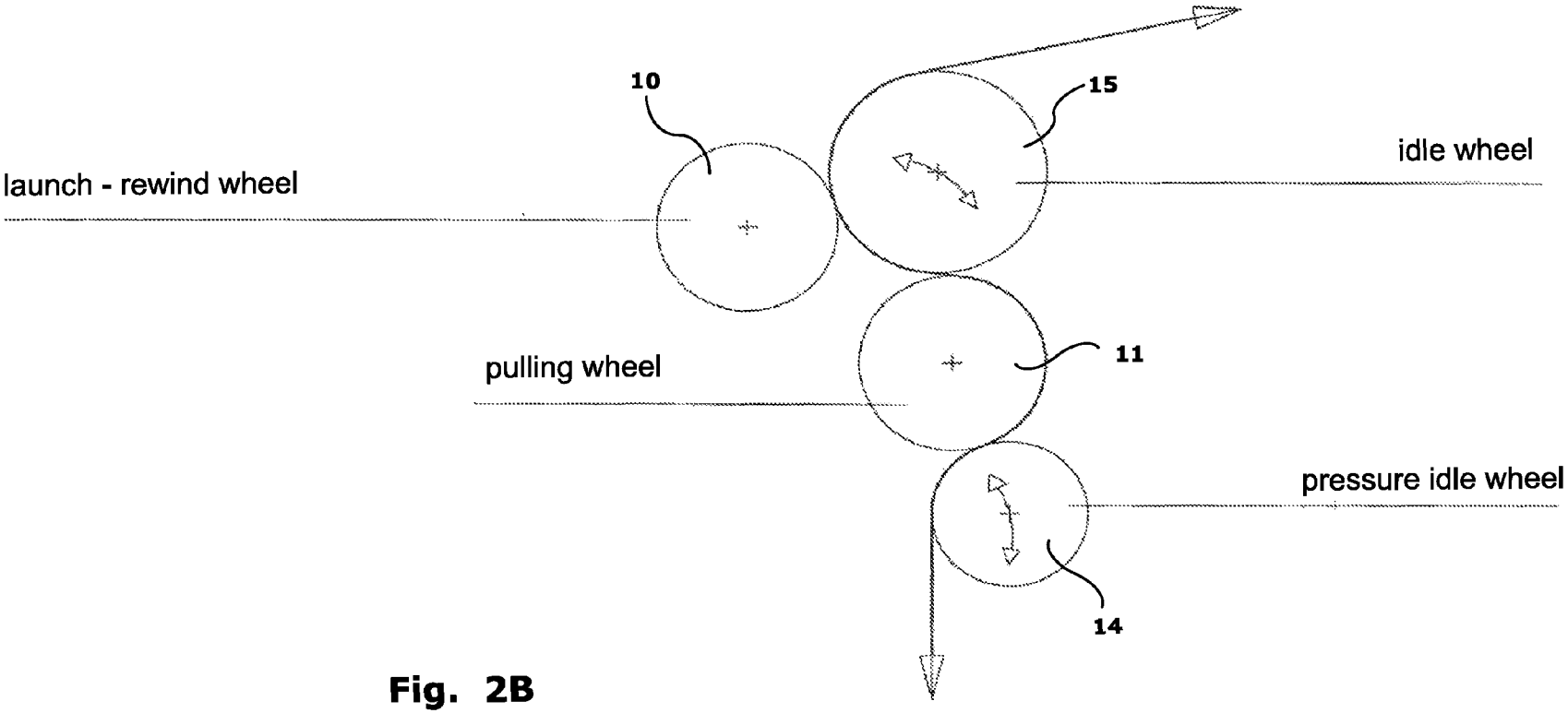
FIG. 2B is a schematic view of the wheels of the launch and rewind assembly of FIG. 2A.
Figure 5:
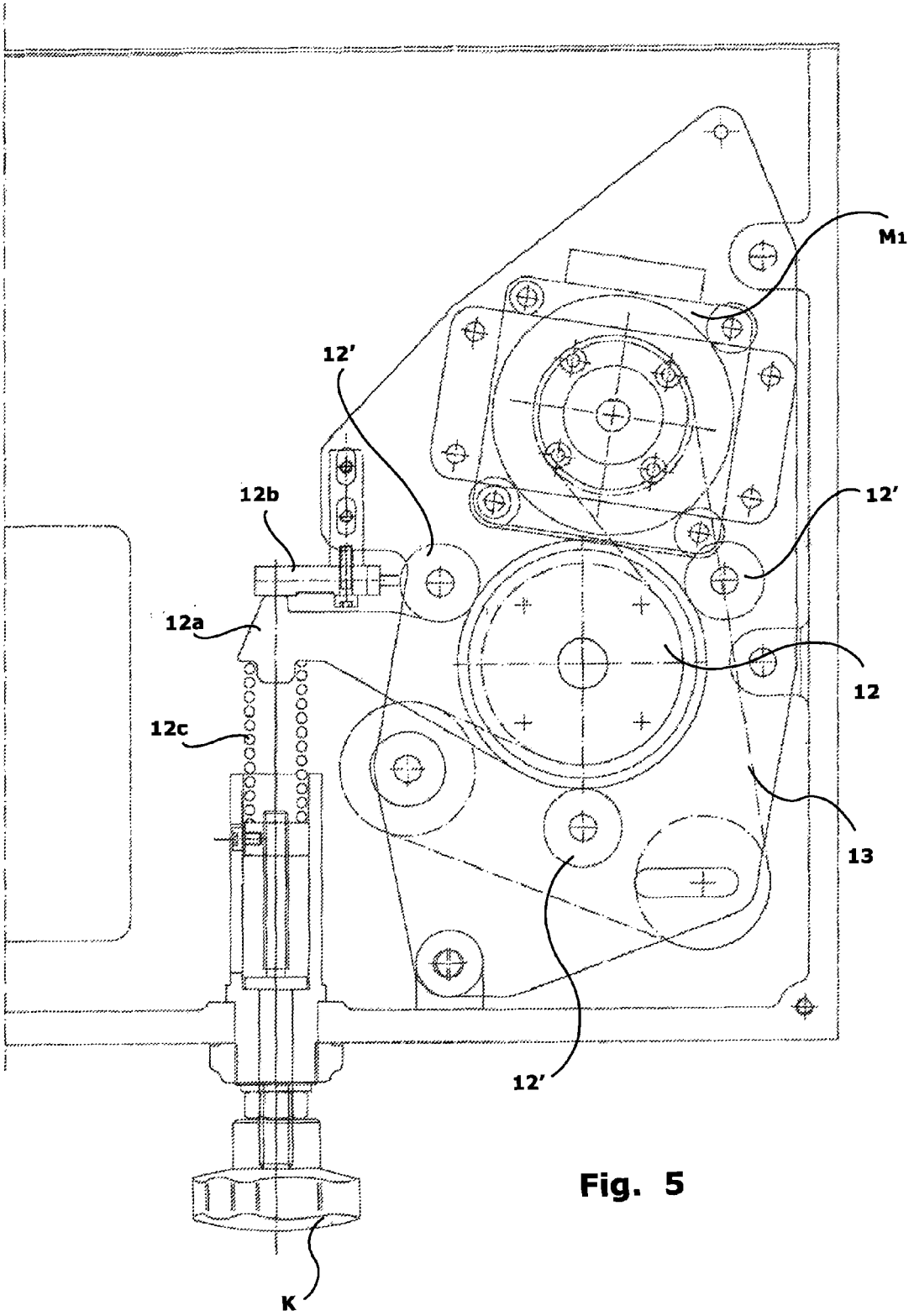
FIG. 5 is an elevation side view of the launch and rewind assembly taken from the opposite part of FIG. 1A.

Launch and rewind assembly 1 is better illustrated in FIGS. 2A, 2B and 5. It consists, in ways known per se, of a plurality of wheels whereon the strap is meant to slide to be led into the two launch and rewind directions.

In particular, according to the embodiment shown in the drawings, assembly 1 consists of a plurality of strap control wheels, which strap is thus led along a winding path suited to transfer the necessary dragging force onto the strap. For such purpose, these wheels have a circumference surface which establishes a friction contact with the strap (not shown), so as to be able to determine the movement thereof as desired.

Assembly 1 comprises a first motorised launch and rewind wheel 10 and a second motorised pulling wheel 11.

The rotation control to these two wheels comes from a motor $M_1$, arranged in axis with the first launch and rewind wheel 10, which controls also pulling wheel 11 through a reducer 12 coupled therewith. As visible in FIG. 5, motor $M_1$ transfers traction force to reducer 12 through a drive belt 13.

Assembly 1 furthermore comprises a first idle pressure wheel 14 and a second idle opposition wheel 15. These two idle wheels are mounted oscillating around a centre of instant rotation offset with respect to the rotation axis thereof. Thereby, as schematically shown in FIG. 2B, the two idle wheels 14 and 15 can move alternately between two different contact positions or contactless positions with nearby motorised wheels 10 and 11, establishing different states of operation. The oscillation between the different positions of the two idle wheels 14 and 15 is determined by the contrasting pulling action of the strap which runs over them and of adjustable elastic means, known per se.

Reducer 12 is mounted with its containment case free to rotate on three outer support bearings 12'. The rear part of the containment case is furthermore integral with a lever 12*a*, said lever kept pushed in an operating position against a fixed microswitch 12*b*, through adjustable spring means 12*c*. Lever 12*a* can rotate integrally with reducer 12, around the same axis of instant rotation defined by the three bearings 12', but is kept stable resting against microswitch 12*b* through spring 12*c*.

During the strap pulling step, reducer 12 undergoes a twisting reaction which tends to cause it to rotate, integrally with lever 12*a*, which twisting, however, is contrasted by the torsion imparted by spring 12*c* through the arm of lever 12*a*. When instead the pulling force of the strap exceeds a certain threshold, the twisting reaction is so high that lever 12*a* overcomes the thrust of adjustable spring 12*c* and can hence partly rotate, becoming detached from microswitch 12*b*: thereby a signal is generated by microswitch 12*b* which halts the operation of motor $M_1$ and hence causes the strap rewind step to halt.

Adjustable spring means 12*c* are capable of imparting an elastic reaction force, greater or smaller based on how much they are compressed by a registration bush actuated by a knob K. Knob K is arranged outside frame C, so as to be able to be easily accessed by an operator. Therefore, depending on the position taken up by knob K, adjustable spring 12*c* pushes with a greater or smaller force lever 12*a* against fixed microswitch 12*b*, thereby determining the threshold value of the torque which may be absorbed by reducer 12 before triggering the microswitch and, in the last analysis, the pulling force imposed to the strap during rewind.

The strap, coming from the strap storage below the strapping head, passes over idle wheel 14, partly winding in a clockwise direction (in the plane of FIG. 2A), then in an anti-clockwise direction on pulling wheel 11 and finally in a clockwise direction on idle wheel 15, coming out from the strapping head through launch track 16.

During the launch step (main rotation) and the entire initial rewind step (inverse rotation), contrast wheel 15 is kept pushed against launch wheel 10 (which rotates first in one direction and then in the other). In the first step of tightening the strap around the product, idle wheel 14 is brought to rest towards pulling wheel 11, so as to increase the friction effect. In the last strap-tensioning step, due to the pulling force on the strap, also contrast wheel 15 is displaced and pushed to rest against pulling wheel 11, so as to remarkably increase strap friction around motorised pulling wheel 11 and complete the last strap tensioning step.

According to an advantageous aspect, all the strap guiding wheels, that is, wheels 10, 11, 14 and 15, are installed on the opposite side of transmission wheels 12, 13 and of motor $M_1$ with respect to a partition wall $C_2$ of frame C. As a matter of fact, according to a preferred embodiment, the box frame C of the strapping head has a longitudinal dividing diaphragm $C_2$, provided with suitable bearing bushes and cut-outs, preferably obtained integrally (for example by die-casting) with the remaining walls of frame C. This partition wall or diaphragm represents a sort of stiffening ordinate of the box frame, to which the various control members may be fastened. That implies a twofold advantage. On the one hand, a longitudinal diaphragm cooperates to the intrinsic rigidity of the frame, which can hence be overall lighter; on the other hand, the driving members can be constrained to central partition wall $C_2$, protruding from the two opposite sides, so as to make superfluous—from a structural point of view—the opposite closing walls of the box frame, which can thus be light and removable for easy access to the inside of the strapping head.

Figure 4:
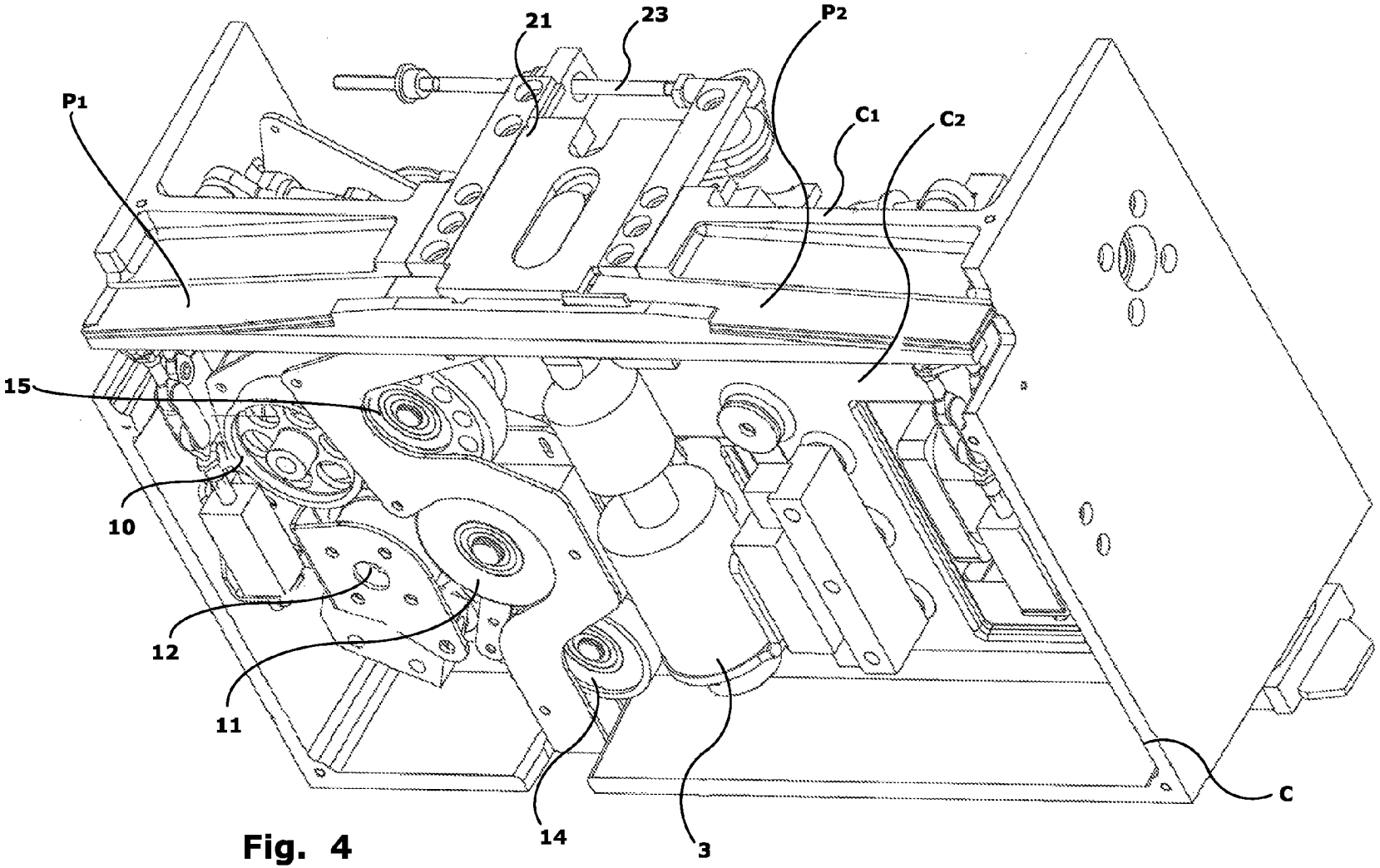
FIG. 4 is a perspective top plan and side view illustrated in FIG. 1A, of a preferred embodiment of the invention.
Figure 4B:
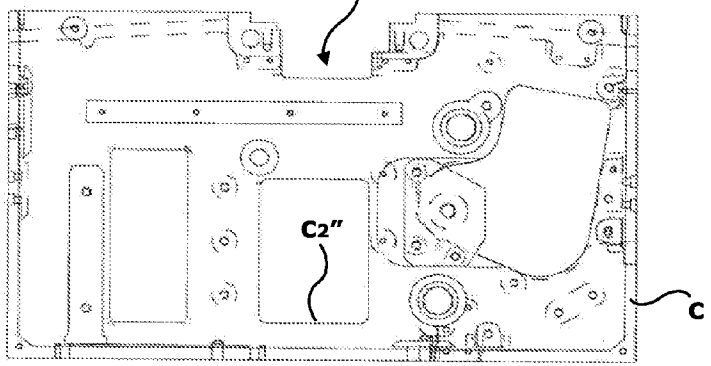
FIGS. 4A-4D are elevation side views from the two sides, and top plan and bottom plan views, respectively, of sole frame component C.
Figure 4D:
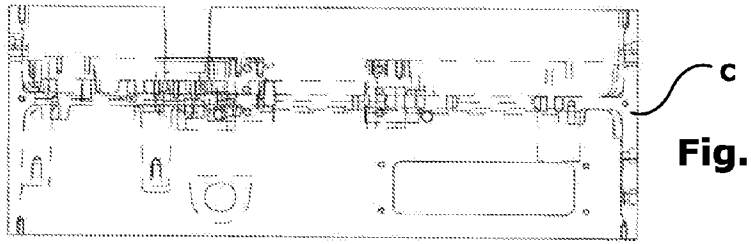
Figure 4A:
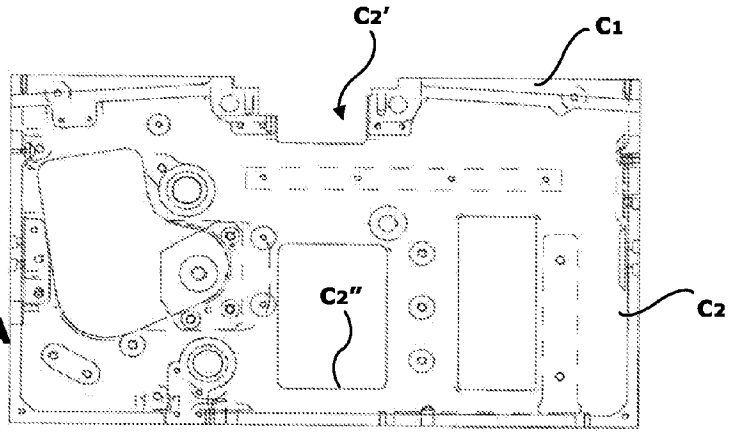
Figure 4C:
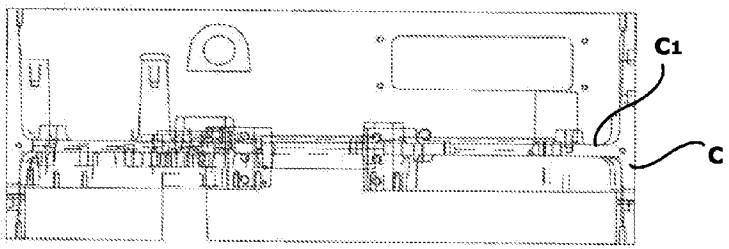

As clearly visible in FIG. 4, on one side of partition wall $C_2$ the guiding wheels of launching and tensioning assembly 1 are installed, as well as welding device 3, which will be illustrated further on.

In the upper part of frame C, again on the side of launching and tensioning assembly 1, two portions of launch and rewind track $P_1$ and $P_2$ are provided, between which cutting and welding unit 2 is mounted: this latter unit is arranged across the partition wall $C_2$ of frame C. For such purpose, partition wall $C_2$ has an upper cut-out $C_2'$ which houses the components—known per se—for the tightening, cutting and welding of the strap. In particular, in correspondence of cut-out $C_2'$ an abutment plate is arranged for the welding system, which plate is mounted sliding in a crosswise direction, as will be illustrated further on.

Figure 3B:
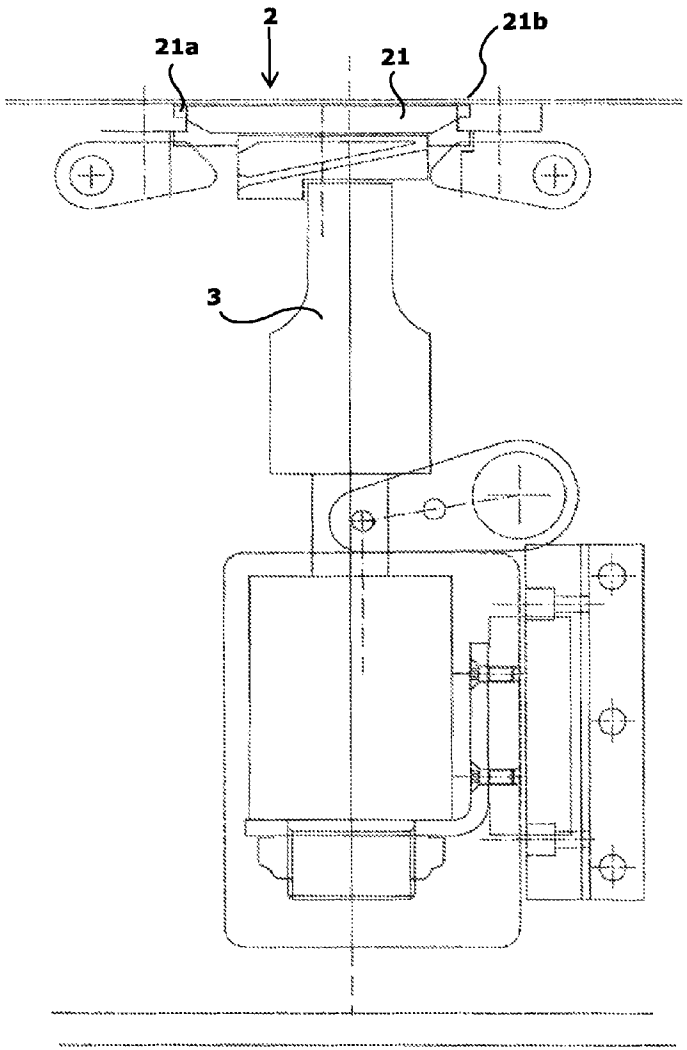
FIG. 3B is a detailed view according to the view of FIG. 1A, of the detail illustrated also in FIG. 3A.
Figure 3A:
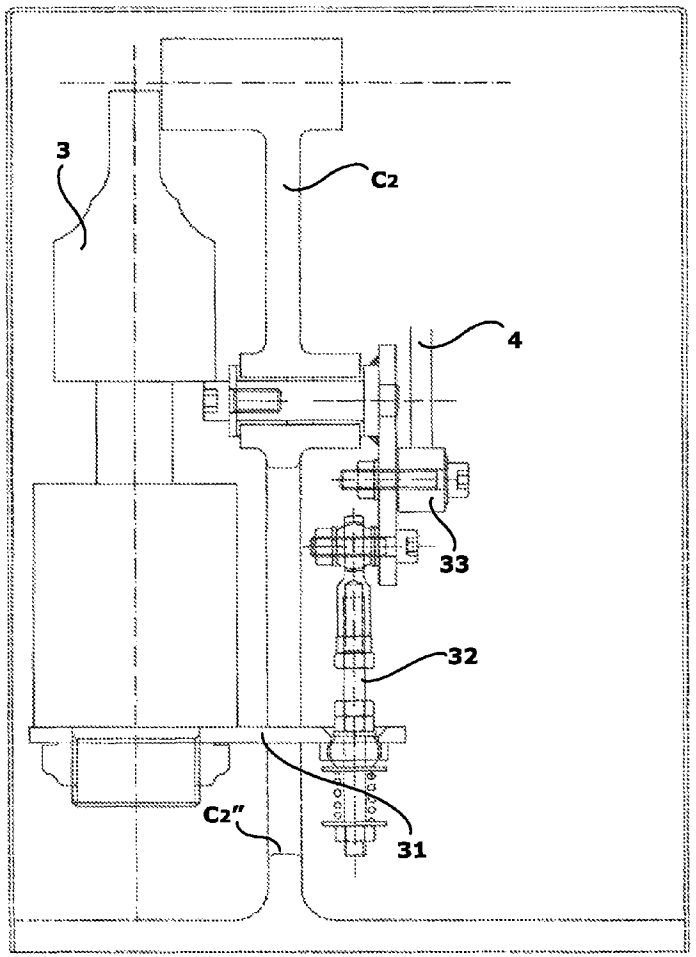
FIG. 3A is a section view taken along the line III-III of FIG. 1A.

FIGS. 3A and 3B show a detail of a possible welding device, it being understood that the essential principles of the invention remain unchanged also employing a different welding device. An ultrasound welder (sonotrode) 3 is arranged with its main axis orthogonal to the welding plane, that is, in a vertical attitude in the head as installed. The welder is advantageously fastened to the partition wall $C_2$ of frame C and the activation thereof is controlled by a lever mechanism 31 which runs across a cut-out $C_2''$ of partition wall $C_2$, until engaging with a control rod 32 (FIG. 3A) actuated in an innovative way which will be illustrated in the following.

The activation of sonotrode 3 transfers ultrasound energy to the above-lying cutting and welding unit 2 within which the joining of the two strap portions and hence the closing of the wrapping loop occur. Further details on the composition and operation of the tightening, cutting and welding unit will not be provided, since they are known to a man skilled in the field and do not form a specific object of the present invention.

In cutting and welding unit 2 an abutment plate 21 is also provided with which the head of sonotrode 3 cooperates to complete the welding. As mentioned above, abutment plate 21 is slidingly mounted in a crosswise direction to the longitudinal axis of the strapping head: as a matter of fact, it acts as contrast to welding device 3 in the closing step of the strapping loop, but must then be removed crosswise to the strap path, to be able to free the closed strapping loop and hence the wrapped package.

For such purpose, abutment plate 21 is slidingly mounted on lateral guides 21*a* and 21*b* and a central guide 21*c* and is controlled in its travel by a lever mechanism 22 (FIG. 8), in turn actuated by the contrasting actions of an elastic thrust rod 23 and of a profiled cam 24. According to an essential aspect of the invention, which will be addressed again further on, profiled cam 24 is a linear cam, i.e. it consists of a shaped profile provided with alternated rectilinear movement along longitudinal direction (arrow F) of the strapping head. In particular, this first linear cam has a cam profile developing on an horizontal plane, hence resulting in a displacement of the follower device on the horizontal plane.

Figure 8:
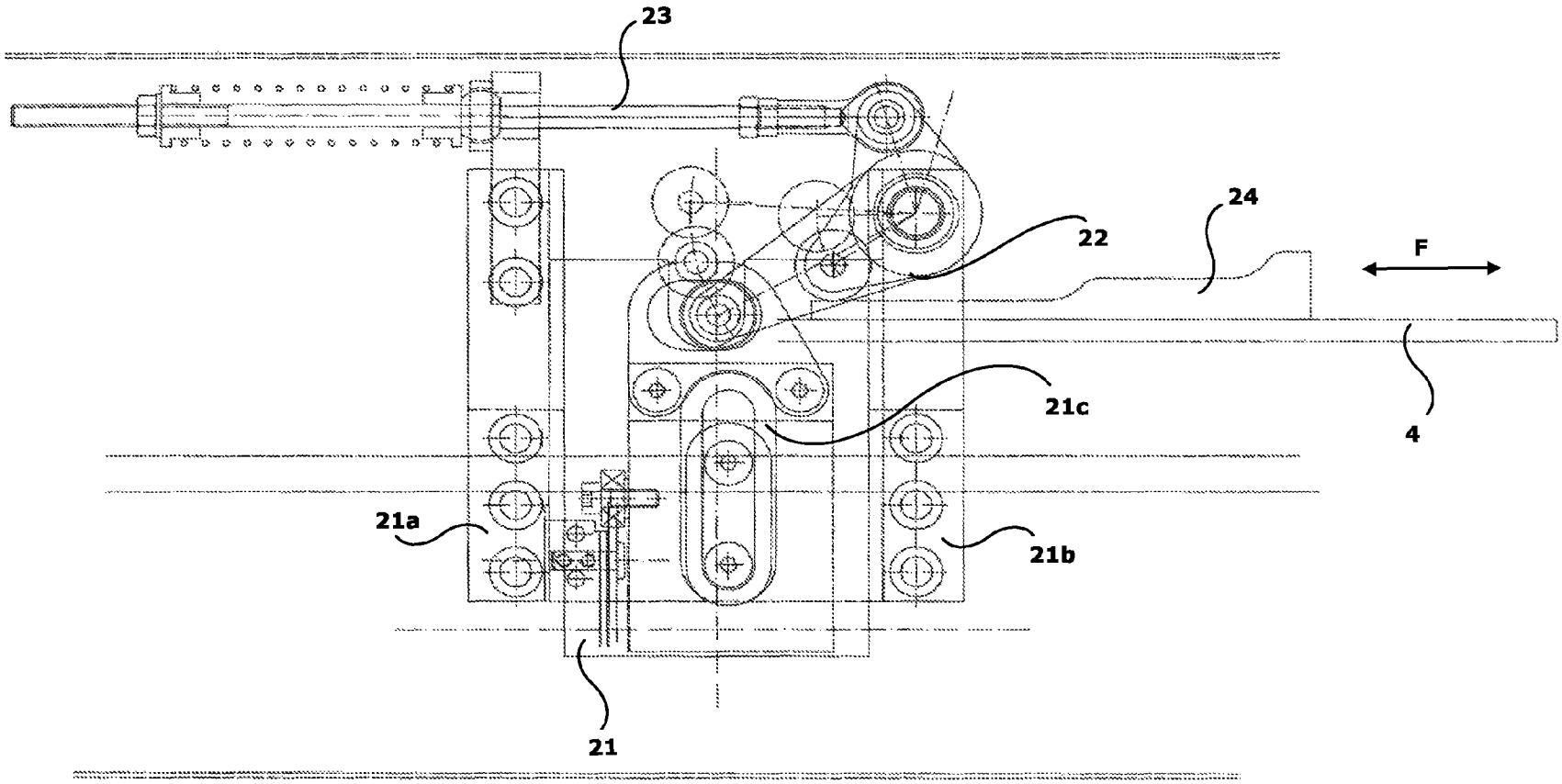
FIG. 8 is a top plan interrupted view of the abutment slider in the welding assembly.
Figure 9:
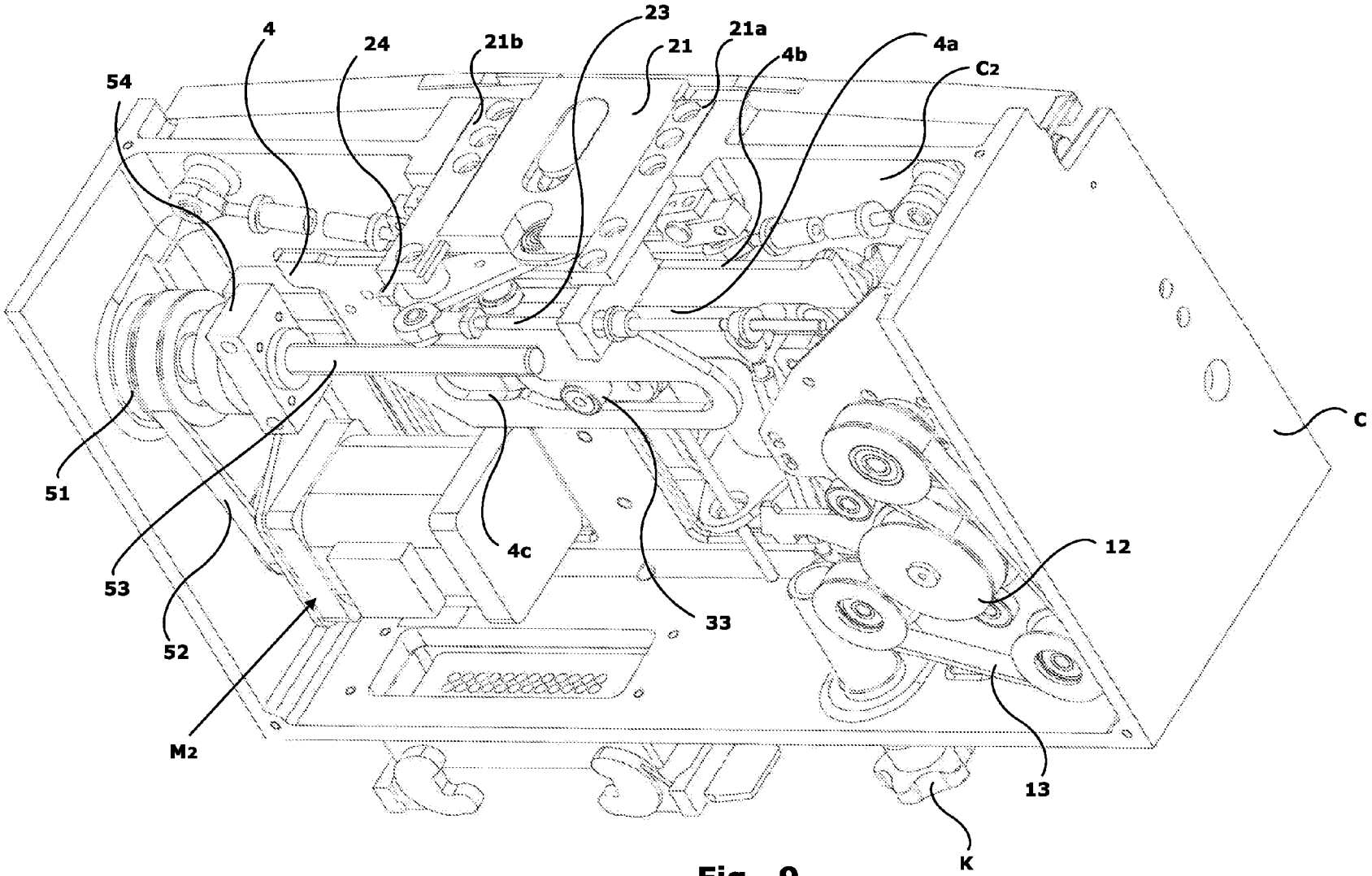
FIG. 9 is a perspective view of the head according to a preferred embodiment of the invention, taken from above and from the side of FIG. 6A.

FIG. 8 shows the typical intervention position of the abutment plate 21, wherein it protrudes above the area affected by the strap (not shown) to impart its cooperation function with the underlying welding device. This position is actively maintained due to the thrust imparted on lever mechanism 22 by elastic rod 23. When it is necessary to free the wrapped package, at the end of the strapping cycle, sliding plate 21 is caused to move backwards (that is, to move back up in the drawing of FIG. 8) through the action of the linear cam 24, which overcomes the reaction of elastic rod 23 by pushing upward (in the drawing of FIG. 8) the follower integral with the lever 22.

According to a particularly advantageous aspect of the invention, the action on all the various control members of abutment plate 21 (more in general, on the entire cutting and welding unit 2), of welding device 3 and of launch and tensioning assembly 1, is achieved with a single linear cam 4 displaced by a respective actuation motor $M_2$.

Figure 6A:
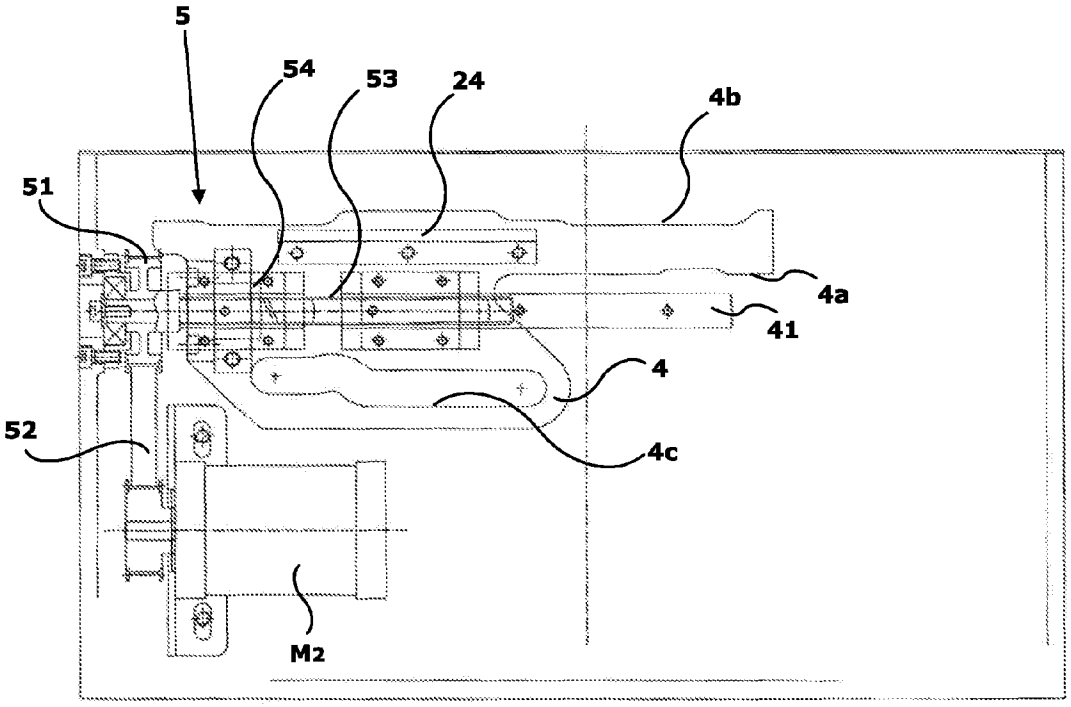
FIG. 6A is an elevation side view, with parts removed, taken from the side opposite to that of FIG. 1A.
Figure 7:
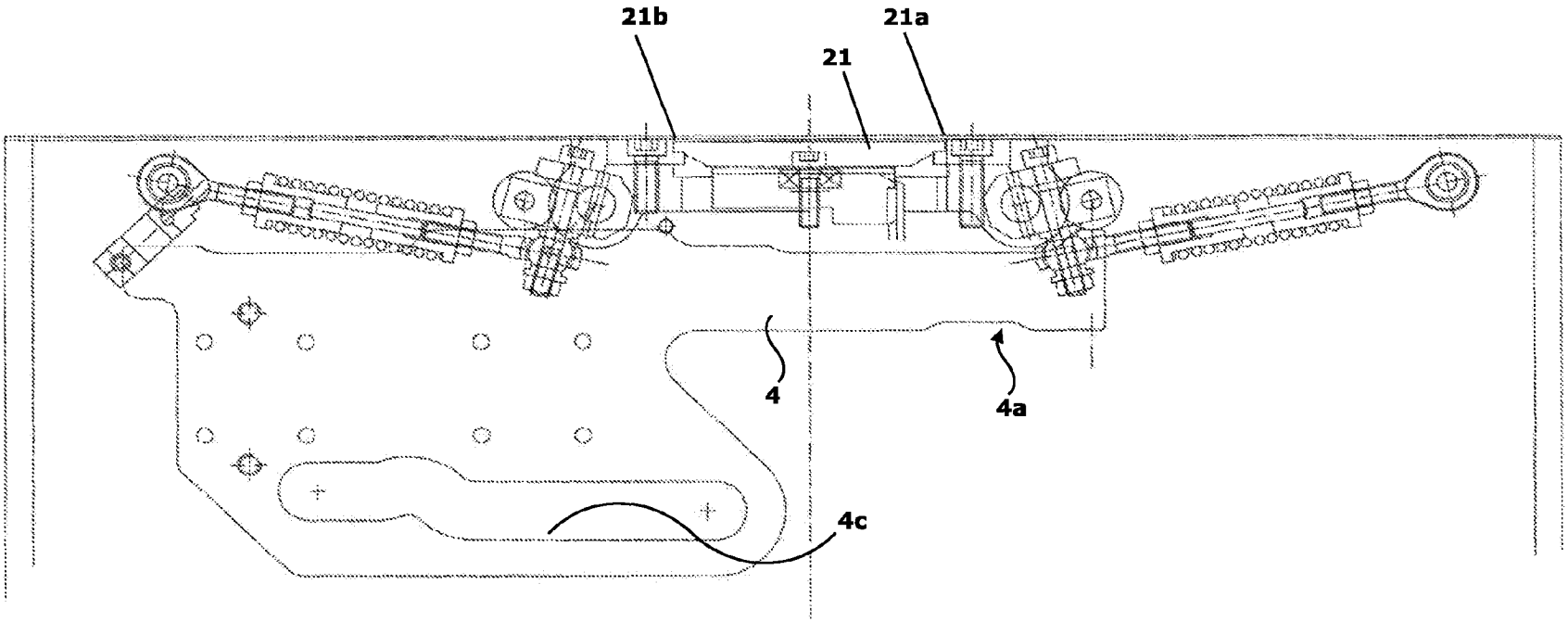
FIG. 7 is an elevation side view, taken from the same side of FIG. 6A, of the detail of the linear cam according to the invention.

As clearly shown in FIGS. 6A and 7, linear cam 4 is in the shape of a suitably-shaped planar plate, constrained to frame C—better, to partition wall $C_2$—according to an alternate linear movement along the longitudinal axis of the strapping head. In particular, linear cam 4 is slidingly mounted on a rail 41 fastened to the partition wall $C_2$ of frame C.

On linear cam 4 shaped cam surfaces are obtained, both along the respective edges, such as for example portions 4*a*, 4*b* and slit 4*c* (to define cam controls on the sliding plane, that is, on the vertical plane), and along profiles orthogonal thereto obtained on solid bodies fastened to planar plate 4, such as for example profile 24, to define cam controls orthogonal to the sliding plane, that is, on the horizontal plane.

According to the embodiment shown (FIGS. 6A and 7), the cam controls on the vertical plane are the ones of a first profile 4*a* which acts on the control of strap launch and rewind wheels, of a second profile 4*b* which acts on the control of the strap tightening grippers arranged below abutment plate 21, and of a slit 4*c* which acts on rod 32 (through the bush 33 guided into slit 4*c*) actuating welding device 3. The control on the horizontal plane is that of profile 24—shaped on the horizontal plane—which acts on the lever mechanism 22 of abutment plate 21. The same lever mechanism, along part of the travel thereof, also controls the displacement of a lower abutment plate which acts also as strap cutter (step not shown).

For the cam control to occur at the desired moments of the working cycle of the strapping head, linear cam 4 is advantageously controlled in translation by a step motor and by a screwed spindle and nut transmission mechanism 5, more preferably a recirculating ball screw.

Figure 6B:
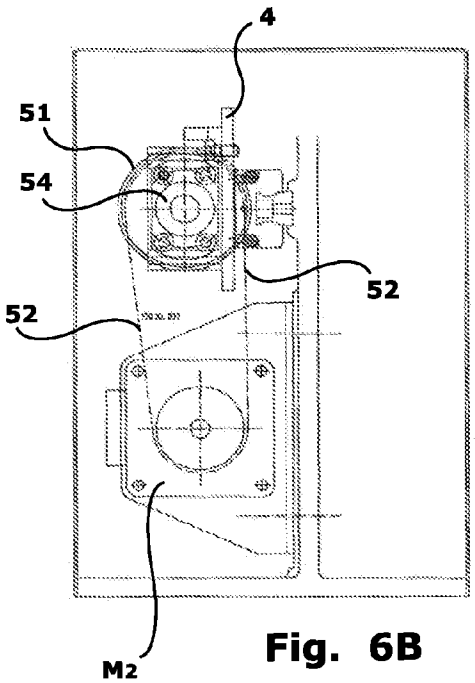
FIG. 6B is a section view taken along the line VI-VI of FIG. 6A.

As clearly shown in FIGS. 6A and 6B, a motor $M_2$, preferably a step motor, drives into rotation a driving wheel 51 through a belt transmission 52. On the rotation axis of driving wheel 51 a helical-groove screwed spindle 53 (schematised in the drawings as a smooth shaft) which extends according to the longitudinal axis of the strapping head, parallel to the linear displacement path of linear cam 4, is mounted, integral in rotation. Grooved screwed spindle 53 is engaged with a corresponding recirculating ball body 54 which is fastened integral with the plate of linear cam 4. With this configuration, the rotation of motor $M_2$ causes a corresponding rotation of the helical-groove screwed spindle 53 and as a result a linear displacement of body 54 and of linear cam 4.

Due to the use of a step motor and to the transmission, it is possible to control with high accuracy the position and displacement speed of linear cam 4, so as to have a significant flexibility and precision in the definition of the actuation laws of the driving members. It must be noticed that, being able to finely adjust also the displacement speed of linear cam 4, significant idle times can be provided within a strapping cycle, by efficiently exploiting the cam displacement travel, which can thus be kept as short as possible (which give advantage in term of bulk of the mechanism).

Typically the cam profiles are conceived to function actively in a certain direction of progress of linear cam 4, for example from left to right in FIG. 6A. The return travel of cam 4 can be performed in the idle time of the work cycle, consisting of the step of moving away of the wrapped package and of arrival of the new package to be wrapped, in which step the strapping head does not have to perform any active operation. This step, which in the conventional, circular-cam controls, uselessly occupies a significant angular portion of each cam, is synergistically exploited by the embodiment according to the invention, since it is employed for the empty return of a linear cam, the advantageous features of which can instead be exploited in the active forward step.

The provision of a linear cam, which acts on one of the two sides of partition $C_2$, exploiting the travel on the longitudinal length of the strapping head, implies a series of advantageous results.

The law of actuation of the various driving members can be configured in a precise and flexible way, also due to the use of a step motor which acts with a screwed spindle and nut transmission. Exploiting the travel of the linear cam on the head length, it is not necessary to employ large and heavy rotating cams, safeguarding the weight and bulk of the strapping head. With a simple pair of motors, the one $M_1$ for driving the wheels of assembly 1 and the other $M_2$ for controlling all the driving members through the linear cam, it is possible to provide all the actuations necessary for the operation of the strapping head. Finally, the fastening of the various component members to the head walls and to the partition $C_2$ of frame C, allows to remarkably simplify frame C, to the benefit of lightness and of accessibility for maintenance: the entire head ends up having a length of the order of 400 mm and a width of the order of 160 mm, for an overall weight of the order of only 20 Kg.

However, it is understood that the invention is not limited to the special embodiment illustrated above, which represents only a non-limiting example of the scope of the invention, but that a number of variants are possible, all within the reach of a person skilled in the field, without departing from the scope of the invention as defined in the attached claims.

The invention claimed is:

1. A strapping head for a strapping machine, comprising a containment frame (C) suitable to house at least a strap launch/rewind path defined by a launch/tensioning assembly (1) comprising a plurality of driving wheels (10, 11, 12, 13, 14, 15) of said strap, a welding assembly (3) and a gripping and cutting device (2) comprising locking grippers, a moving abutment plate and a cutter, said driving wheels of the launch/tensioning assembly being brought into rotation by a first actuation motor ($M_1$), wherein all of said launch/tensioning assembly (1), welding assembly (3) and gripping and cutting device (2) have driving members driven into movement through a single linear cam (4) configured to move alternately in a longitudinal direction through a second actuation motor ($M_2$) and having cam profiles both on a horizontal plane and on a vertical plane, and said linear cam (4) is actuated by said second driving motor ($M_2$) being integral in rotation with screwed spindle transmission means mutually cooperating with screw nut means integral with said linear cam (4).

2. The strapping head as claimed in claim 1, wherein said screwed spindle transmission means are in the shape of a helical-groove screwed spindle (53) engaged with said screw nut transmission means in the shape of a recirculating ball body (54) integral in translation with said linear cam (4).

3. The strapping head as claimed in claim 1, wherein said second actuation motor ($M_2$) is connected to said screwed spindle transmission means through a pulley transmission.

4. The strapping head as claimed in claim 1, wherein said containment frame (C) is box-shaped and is divided by a longitudinal diaphragm ($C_2$), whereon sliding guiding means are fastened (41) for said linear cam (4).

5. The strapping head as claimed in claim 4, wherein said linear cam (4) is arranged on a first side of said longitudinal diaphragm ($C_2$), while said launch/rewind path of the strap is arranged on the opposite side.

6. The strapping head as claimed in claim 4, wherein said longitudinal diaphragm ($C_2$) has at least an upper cut-out ($C_2'$) which houses a crosswise displacement path of said moving abutment plate (21).

7. The strapping head as claimed in claim 4, wherein said driving wheels (10, 11, 12, 13, 14, 15) are driven by motor shafts arranged crosswise to said longitudinal diaphragm ($C_2$).

8. The strapping head as claimed in claim 1, wherein said linear cam (4) is in the shape of a planar plate provided with first cam profiles (4*a*, 4*b*, 4*c*) obtained on shaped edges, for defining cam controls on the sliding vertical plane, and second cam profiles (24), orthogonal to said first profiles, obtained on small bodies protruding from the plate plane, for defining cam controls orthogonal to the sliding vertical plane.

9. The strapping head as claimed in claim 8, wherein said moving abutment plate of the gripping and cutting device (2) is driven crosswise by said second cam profiles (24).

10. The strapping head as claimed in claim 2 wherein said second actuation motor ($M_2$) is connected to said screwed spindle transmission means through a pulley transmission.

11. The strapping head as claimed in claim 2 wherein said containment frame (C) is box-shaped and is divided by a longitudinal diaphragm ($C_2$), whereon sliding guiding means are fastened (41) for said linear cam (4).

12. The strapping head as claimed in claim 3 wherein said containment frame (C) is box-shaped and is divided by a longitudinal diaphragm ($C_2$), whereon sliding guiding means are fastened (41) for said linear cam (4).

13. The strapping head as claimed in claim 5 wherein said longitudinal diaphragm ($C_2$) has at least an upper cut-out ($C_2'$) which houses a crosswise displacement path of said moving abutment plate (21).

14. The strapping head as claimed in claim 5 wherein said driving wheels (10, 11, 12, 13, 14, 15) are driven by motor shafts arranged crosswise to said longitudinal diaphragm ($C_2$).

15. The strapping head as claimed in claim 6 wherein said driving wheels (10, 11, 12, 13, 14, 15) are driven by motor shafts arranged crosswise to said longitudinal diaphragm ($C_2$).

16. The strapping head as claimed in claim 2 wherein said linear cam (4) is in the shape of a planar plate provided with first cam profiles (4*a*, 4*b*, 4*c*) obtained on shaped edges, for defining cam controls on the sliding vertical plane, and second cam profiles (24), orthogonal to said first profiles, obtained on small bodies protruding from the plate plane, for defining cam controls orthogonal to the sliding vertical plane.

17. The strapping head as claimed in claim 3 wherein said linear cam (4) is in the shape of a planar plate provided with first cam profiles (4*a*, 4*b*, 4*c*) obtained on shaped edges, for defining cam controls on the sliding vertical plane, and second cam profiles (24), orthogonal to said first profiles, obtained on small bodies protruding from the plate plane, for defining cam controls orthogonal to the sliding vertical plane.

18. The strapping head as claimed in claim 4 wherein said linear cam (4) is in the shape of a planar plate provided with first cam profiles (4*a*, 4*b*, 4*c*) obtained on shaped edges, for defining cam controls on the sliding vertical plane, and second cam profiles (24), orthogonal to said first profiles, obtained on small bodies protruding from the plate plane, for defining cam controls orthogonal to the sliding vertical plane.

19. The strapping head as claimed in claim 5 wherein said linear cam (4) is in the shape of a planar plate provided with first cam profiles (4*a*, 4*b*, 4*c*) obtained on shaped edges, for defining cam controls on the sliding vertical plane, and second cam profiles (24), orthogonal to said first profiles, obtained on small bodies protruding from the plate plane, for defining cam controls orthogonal to the sliding vertical plane.

20. The strapping head as claimed in claim 6 wherein said linear cam (4) is in the shape of a planar plate provided with first cam profiles (4*a*, 4*b*, 4*c*) obtained on shaped edges, for defining cam controls on the sliding vertical plane, and second cam profiles (24), orthogonal to said first profiles, obtained on small bodies protruding from the plate plane, for defining cam controls orthogonal to the sliding vertical plane.

* * * * *